US005702219A

United States Patent [19]

Hattori

[11] Patent Number: 5,702,219

[45] Date of Patent: Dec. 30, 1997

[54] APPARATUS FOR AND PROCESS OF BOOKBINDING

[75] Inventor: Katsuyoshi Hattori, Takatsuki, Japan

[73] Assignee: Kabushiki Kaisha Kanpuri, Takatsuki, Japan

[21] Appl. No.: 607,343

[22] Filed: Feb. 26, 1996

[51] Int. Cl.[6] ..... B42B 5/08

[52] U.S. Cl. ..... 412/6; 412/1; 412/9; 412/33

[58] Field of Search ..... 412/1, 8, 3, 9, 412/17, 25, 30, 37, 902, 6, 33

[56] References Cited

U.S. PATENT DOCUMENTS

| | | | |
|---|---|---|---|
| 4,106,148 | 8/1978 | Axelrod | 412/37 X |
| 4,153,276 | 5/1979 | Ohlsson | 412/37 X |
| 5,108,244 | 4/1992 | Bellanca | 412/37 |
| 5,137,593 | 8/1992 | Walter | 412/37 X |
| 5,542,800 | 8/1996 | Detterman et al. | 412/37 X |

*Primary Examiner*—Willmon Fridie, Jr.
*Attorney, Agent, or Firm*—Armstrong, Westerman Hattori, Mcleland & Naughton

[57] ABSTRACT

An apparatus for and a process of bookbinding is provided which permit automatic back-bonding of bookbinding by folding a plurality of paper sheets in two with the wrong sides of the plurality of paper sheets, i.e., the sides not bearing any characters or drawings thereon, as the outer sides and applying together the folded paper sheets on the wrong sides thereof. The bookbinding apparatus includes folding facilities for folding each paper sheet in two with the wrong side as the outer side, stacking facilities for stacking the folded paper sheets by feeding the paper sheets successively to a predetermined position on a plate-like member, and adhesive applying facilities for applying adhesive material to the wrong side of each folded paper sheet fed to the predetermined position. The folded paper sheets fed to the plate-like member are thus bonded together successively on the wrong sides thereof.

20 Claims, 10 Drawing Sheets

APPARATUS FOR AND PROCESS OF BOOKBINDING

BACKGROUND OF THE INVENTION

The present invention relates to an apparatus for and a process of back-bonding bookbinding by folding a plurality of paper sheets in two with their wrong sides not bearing any characters or drawings as the outer side and applying together the folded paper sheets on their wrong sides.

It has been in practice to bind drawings, documents, etc. into books for the purpose of filing. Such books are produced by various processes. For binding large size drawing sheets such as blue prints of civil and construction concerns, back-bonding bookbinding is adopted for producing books to be spread for observing drawings. An example of the back-bonding bookbinding process is shown in FIG. 10. In this process, a plurality of paper sheets 1 are folded in two with their wrong sides 2 not bearing any characters or drawings as the outer side, and the folded paper sheets 1 are bonded together with adhesive 3 on their wrong sides. By this process, books can be produced which are to be spread for observing characters or the like expressed on their right sides 4.

However, the above described process involves very cumbersome and time-consuming manual operations such as folding the paper sheets 1, applying adhesive 3, arranging the ends of the folded paper sheets 1 and stacking the wrong sides 2 of folded paper sheets 1 each other. In addition, since the paper sheets 1 are bonded together manually, their bonding is inaccurate due to their inevitable deviations.

The inventor has conducted extensive researches and investigations for the purpose of solving the above problems, and ultimately the present invention has been obtained.

BRIEF SUMMARY

The subject of the bookbinding apparatus according to the present invention is in that an apparatus for bookbinding for back-bonding by folding a plurality of paper sheets bearing characters or the like on their right sides in two with their wrong sides not bearing any characters or the like as the outer side and applying together the folded paper sheets on their wrong sides, comprising folding means for folding the paper sheets in two with their wrong sides as the outer side, stacking means for stacking the folded paper sheets while successively feeding the paper sheets to a predetermined position on a plate-like member, and adhesive applying means for applying adhesive material to the wrong sides of the paper sheets fed to the predetermined position, and characterized in the paper sheets being successively bonded together on their wrong sides as they are fed to the plate-like member.

The bookbinding apparatus according to the present invention comprises pressing means for pressing together a plurality of folded paper sheets stacked by the stacking means.

The bookbinding apparatus according to the present invention comprises paper feeding means for successively feeding paper sheets one at a time to the folding means.

The bookbinding apparatus according to the present invention comprises shifting means for causing step-wise shifting of the plate-like member by a constant distance in each step in the direction opposite to the direction of stacking paper sheets by the stacking means.

The bookbinding apparatus according to the present invention comprises a guide plate for feeding paper sheets by sliding them in order that the paper sheets can be stacked on the plate-like member, and the guide plate being able to shift to avoid interference with other parts.

The bookbinding apparatus according to the present invention comprises fold producing means for producing folds in paper sheets folded in two by the folding means.

Further subject of the bookbinding apparatus according to the present invention is in that the apparatus for bookbinding for back-bonding by folding a plurality Of paper sheets bearing characters or the like on their right sides in two with their wrong sides not bearing any characters or the like as the outer side and applying together the folded paper sheets on their wrong sides, comprising paper feeding means for successively feeding paper sheets one at a time, folding means for folding the paper sheets fed thereto in two with their wrong sides as the outer side, stacking means for stacking the folded paper sheets while successively feeding the paper sheets to a predetermined position on a plate-like member, adhesive applying means for applying adhesive material to the wrong sides of the paper sheets fed to the predetermined position, and pressing means for pressing together a plurality of paper sheets which are stacked by the stacking means and adhered with adhesive material by the adhesive applying means, and characterized in the paper sheets being successively bonded together on their wrong sides as they are fed to the plate-like member.

Further subject of the bookbinding apparatus according to the present invention is in that the apparatus for bookbinding for back-bonding by folding a plurality of paper sheets bearing characters or the like on their right sides in two with their wrong sides not bearing any characters or the like as the outer side and bonding together the folded paper sheets on their wrong sides, comprising paper feeding means for successively feeding paper sheets, folding means for folding the paper sheets fed thereto in two with their wrong sides as the outer side, fold producing means for producing folds in the paper sheets folded in two by the folding means, stacking means for stacking the folded paper sheets while successively feeding the paper sheets to a predetermined position on a plate-like member, adhesive applying means for applying adhesive material onto the wrong sides of the paper sheets fed to the predetermined position, and pressing means for pressing a plurality of paper sheets which are stacked by the stacking means and adhered with adhesive material by the adhesive applying means, characterized in the paper sheets being successively bonded together on their wrong sides as they are fed to the plate-like member.

Further subject of the bookbinding apparatus according to the present invention is in that the apparatus for bookbinding for back-bonding by folding a plurality of paper sheets bearing characters or the like on their right sides in two with their wrong sides not bearing any characters or the like as the outer side and bonding together folded paper sheets on their wrong sides, comprising paper feeding means for successively feeding paper sheets one at a time, folding means for folding the paper sheets fed thereto in two with their wrong sides as the outer side, fold producing means for producing folds in the paper sheets folded in two by the folding means, stacking means for stacking the folded paper sheets while successively feeding the paper sheets to a predetermined position on a plate-like member, shifting means for causing step-wise shifting of the plate-like member by a constant distance in each step in the direction opposite to the direction of stacking the paper sheets by the stacking means, and pressing means for pressing a plurality of paper sheets which are stacked by the stacking means and adhered with adhesive material by the adhesive applying means, and characterized in the paper sheets being successively bonded together on their wrong sides as they are fed to the plate-like member.

Further subject of the bookbinding apparatus according to the present invention is in that the apparatus for bookbinding for back-bonding by folding a plurality of paper sheets bearing characters or the like on their right sides in two with their wrong sides not bearing any characters or the like as the outer side and applying together the folded paper sheets on their wrong sides, comprising paper feeding means for successively feeding paper sheets one at a time, folding means for folding the paper sheets fed thereto in two with their wrong sides as the outer side, fold producing means for producing folds in the paper sheets folded in two by the folding means, a guide plate for feeding paper sheets by sliding them in order that the paper sheets can be stacked on the plate-like member, stacking means for stacking the folded paper sheets while successively feeding the paper sheets to a predetermined position on a plate-like member, adhesive applying means for applying adhesive material to the wrong sides of the paper sheets fed to the predetermined position, and pressing means for pressing a plurality of paper sheets which are stacked by the stacking means and adhered with adhesive material by the adhesive applying means, and characterized in the paper sheets being successively bonded together on their wrong sides as they are fed to the plate-like member.

Further subject of the bookbinding apparatus according to the present invention is in that the apparatus for bookbinding for back-bonding by folding a plurality of paper sheets bearing characters or the like on their right sides in two with their wrong sides not bearing any characters or the like as the outside and applying together the folded paper sheets on their wrong sides, comprising paper feeding means for successively feeding paper sheets one at a time, folding means for folding the paper sheets fed thereto in two with their wrong sides as the outer side, fold producing means for producing folds in the paper sheets folded in two by the folding means, a guide plate for feeding paper sheets by sliding them in order that the paper sheets can be stacked on the plate-like member, stacking means for stacking the folded paper sheets while successively feeding the paper sheets to a predetermined position on a plate-like member, shifting means for causing step-wise shift of the plate-like member by a constant distance in each step in the direction opposite to the direction of stacking the paper sheets by the stacking means, adhesive applying means for applying adhesive material to the wrong sides of the paper sheets fed to the predetermined position, and pressing means for pressing a plurality of paper sheets which are stacked by the stacking means and adhered with adhesive material by the adhesive applying means, characterized in the paper sheets being successively bonded together on their wrong sides as they are fed to the plate-like member.

A process of bookbinding according to the present invention comprises a process of back-bonding bookbinding by folding a plurality of paper sheets bearing characters or the like on their right sides in two with their wrong sides not bearing any characters or the like as the outer side and applying together the folded paper sheets on their wrong sides, and the paper sheets being successively bonded together on their wrong sides by the steps of folding the paper sheets in two with their wrong sides as the outer side with folding means, and applying together the folded paper sheets on their wrong sides by feeding the folded paper sheets to a predetermined position on a plate-like member for stacking with stacking means while applying adhesive material to the wrong sides of the paper sheets with adhesive applying means.

The process of bookbinding according to the present invention comprising the plate-like member is shifted step-wise by a constant distance in each step in the direction opposite to the direction of stacking the paper sheets by the stacking means.

The process of bookbinding according to the present invention comprising that while the guide plate is shifted in the condition of not interfering with other parts, the paper sheets are fed by being slid on the guide plate in order to be stacked on the plate-like member.

In the apparatus for bookbinding according to the invention, a plurality of paper sheets to be bonded together are successively fed to the folding means one at a time. The paper sheets fed to the folding means are folded in two with their wrong sides not bearing any characters or drawings as the outer side. The folded paper sheets are successively fed to a predetermined position on the plate-like member, and stacked on the plate-like member. The adhesive applying means applies adhesive material to the wrong sides of the stacked paper sheets on the plate-like member. In this way, the paper sheets fed on the plate-like member are successively bonded together on their wrong sides by that a plurality of paper sheets are successively stacked on the plate-like member and the wrong sides of the paper sheets are applied with adhesive material. When the successive bonding of the wrong sides of all folded paper sheets is completed, a book is obtained, which comprises a plurality of paper sheets folded in two with their wrong sides as the outer side and bonded together on their wrong sides.

In this way, a series of bookbinding operations can be performed automatically, and the bookbinding operation which has been done manually and very cumbersome in prior arts can be readily accomplished. In addition, with the bookbinding apparatus according to the invention folded paper sheets can be bonded together successively while they are stacked at a predetermined position on the plate-like member. The folded paper sheets thus can be bonded together accurately without deviation from the register.

In addition, in the apparatus for bookbinding according to the present invention, which features the pressing means for pressing a plurality of paper sheets stacked by the stacking means, paper sheets bonded together on their wrong sides in a state of being stacked on the plate-like member by the stacking means, are pressed together by the pressing means. As the stacked paper sheets are pressed together by the pressing means, the state of their bonding becomes firmer. It is thus possible to obtain reliable bookbinding without causing any deviation of the stacked folded paper sheets during the operation of bookbinding. In addition, with the pressing of the stacked folded paper sheets by the pressing means, the folds of the paper sheets become clearer to obtain neater bookbinding. It is thus possible to utilize the bookbinding apparatus not only for the bookbinding of drawings and documents but also for the bookbinding of advertisement leaflets or magazines.

In the apparatus for bookbinding according to the invention, which features paper feeding means for successively feeding paper sheets one at a time to the folding means, paper sheets are fed successively from the paper feeding means, in which a plurality of paper sheets are accommodated as a stack, to the folding means one at a time. The successive feeding of the paper sheets to the folding means one at a time precludes the need of manual operation of feeding paper sheets one by one. Therefore, paper sheets thus can be fed successively from the paper feeding means, in which a plurality of paper sheets are accommodated in a stack, to the folding means one at a time. As a result, automatic feeding of paper sheets to the folding means is realized to be able to permit further automation of bookbinding operation.

In the apparatus for bookbinding according to the present invention, which features shifting means for causing the shifting of the plate-like member step-wise by a constant distance in each step in the direction opposite to the direction of stacking of paper sheets by the stacking means, as folded paper sheets are successively fed to a predetermined position on the plate-like member to be stacked upward on the plate-like member, step-wise shift thereof by a constant distance in each step is caused in the direction opposite to the stacking direction. That is, the plate-like member is downwardly shifted step-wise by a constant distance in each step to hold constant the top level of the stacked paper sheets on the plate-like member. With the top position of the paper sheet stack held constant, each paper sheet that is fed successively is accurately stacked and bonded to the top of the paper sheet stack.

In the apparatus for bookbinding according to the invention, which features a guide for feeding folded paper sheets to be stacked on the plate-like member and capable of sliding to avoid interference with other parts, paper sheets folded in two by the folding means are fed onto the plate-like member along the guide. On the other hand, when bonding of adhesive material is performed by the adhesive applying means, the guide is slid and separated from other parts in order to avoid its interference with these other parts. It is thus possible to automate the bonding of adhesive material by the adhesive applying means for further automation of the bookbinding operation.

In the apparatus for bookbinding according to the present invention, which features fold producing means for producing folds of paper sheets folded in two by the folding means, a fold is produced clearly in each paper sheet folded in two, and the paper sheet can be folded tight in two. The paper sheets which are provided with clear folds and folded tight in two, are precisely stacked respectively and bonded to the top of the folded paper sheet stack on the plate-like member.

In the process of bookbinding according to the invention, paper sheets are folded in two with the wrong sides not bearing any characters or the like as the outer side, and the folded paper sheets are fed successively to a predetermined position on the plate-like member for stacking by the stacking means while adhesive material is bonded to the wrong sides of the paper sheets by the adhesive applying means, whereby a book is produced, in which the paper sheets are bonded together on their wrong sides not bearing any characters or the like.

In the process of bookbinding according to the invention, which features shifting the plate-like member step-wise by a constant distance in each step in the direction opposite to the direction of stacking the paper sheets by the stacking means, the plate-like member is downwardly shifted by a constant distance in each step to keep a position of the top of the paper sheet stack constant on the plate-like member so that each successively fed paper sheet can be accurately stacked and bonded to the paper sheet stack.

In the process of bookbinding according to the invention, which features feeding paper sheets by sliding them on the guide plate to be stacked on the plate-like member with the guide plate sliding in the condition of not interfering with other parts, though the folded paper sheets are slid on the guide plate, when applying adhesive material, the guide plate can be slid in the condition of not interfering with other parts such as the adhesive applying means. Thus, the bonding of adhesive material by the adhesive applying means can be automated to permit further automation of the bookbinding operation.

DETAILED DESCRIPTION OF THE INVENTION

The apparatus for and method of bookbinding according to the present invention will now be described in detail following the drawings.

Figure 1:
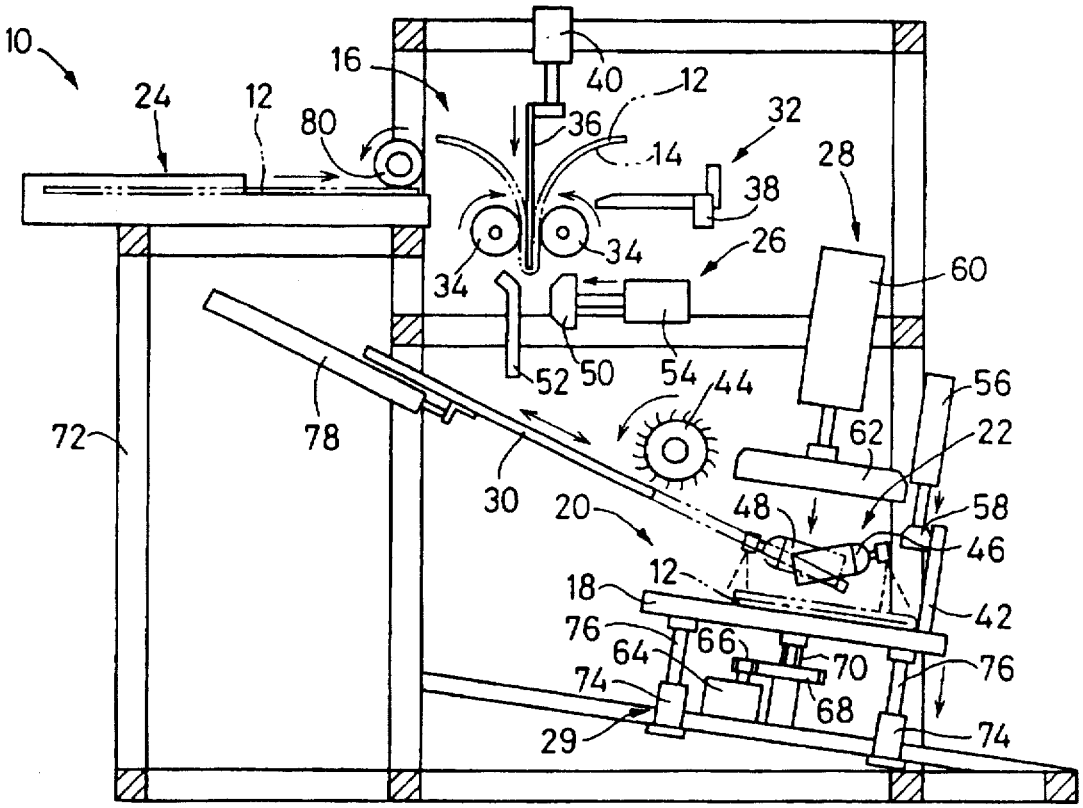
FIG. 1 is a front view showing an example of the bookbinding apparatus according to the present invention.

Referring to FIG. 1, reference numeral 10 designates a bookbinding apparatus embodying the invention. The illustrated bookbinding apparatus 10 performs back-bonding bookbinding by folding a plurality of paper sheets 12 with their right sides bearing characters, drawings, etc. in two with their wrong sides 14 not bearing any characters as the outer side. The apparatus comprises folding means 16 for folding paper sheets in two with their wrong sides 14 as the outer side, stacking means 20 for successively feeding the folded paper sheets to a predetermined position on a plate-like member 18 for stacking, and adhesive applying means 22 for applying adhesive material to the wrong sides 14 of the paper sheets fed to the predetermined position.

The apparatus 10 further comprises paper feeding means 24 for successively feeding paper sheets 12 one at a time to the folding means 16, fold producing means 26 for producing folds in the paper sheets 12 folded by the folding means 16, pressing means 28 for pressing a plurality of paper sheets 12 stacked by the stacking means 20, shifting means 29 for shifting the plate-like member 18 by a constant distance in each step in the direction opposite to the direction of stacking paper sheets by the stacking means 20, and a guide plate 30 for feeding paper sheets 12 by sliding them for being stacked on the plate-like member 18.

The folding means 16 comprises positioning means 32 for stopping paper sheets 12 fed automatically from the paper feeding means 24 at a predetermined position, and an insert plate 36 for folding substantially the center of each paper sheet 12 stopped at the predetermined position and inserting the folded paper sheet 12 between two rollers 32. The positioning means 32 has a sensor 38 for detecting paper sheets 12. The sensor 38 may be of any type; for instance, it is possible to use an optical sensor, a supersonic sensor, etc. The insert plate 36 is moved vertically by a cylinder 40.

The fold producing means 26 for producing a fold in each paper sheet 12 folded in two by the folding means 16, has a pressing member 50, which is pressed against a folded end portion of the paper sheet 12 in contact with a plate 52, thus producing a fold along which the paper sheet 12 is folded in two. The pressing member 50 can be advanced and retreated by a cylinder 54.

The stacking means 20 includes the plate-like member 18, onto which paper sheets 12 fed by being slid on the guide plate 30 are brought, a stopper 42 for stopping the paper sheets 12 at a predetermined position on the plate-like member 18, and a roller 44 with a brush for slowing down the speed of paper sheets 12 which slides down on the guide plate 30.

The pressing means 28 which presses paper sheets 12 stacked on the plate-like member 18 by the stacking means 20 includes the first pressing member 58 slid by a cylinder 56 and the second pressing member 62 slid by a cylinder 60. The first pressing member 58 presses the paper sheets 12 in the neighborhood of the folds, and the second pressing member 62 can press the entire area of the paper sheets 12.

The shifting means 20 for shifting the plate-like member 18 in the direction opposite to the direction of stacking of paper sheets 12 by the stacking means 20, includes a motor 62, gears 66 and 68 being rotated by the motor 62, a screw rod 70 screwed in the gear 68 and secured to the plate-like member 18, four posts 74 secured to a frame 72, and slidable rods 76 slidably inserted in the posts 72. In other words, the plate-like member 18 can be downwardly shifted by a distance corresponding to the thickness of one paper sheet 12 in each step by causing corresponding step-wise rotation of the motor 64.

The guide plate 30 for feeding paper sheets 12 by sliding them for being stacked on the plate-like member 18, is slid by a cylinder 78. In other words, for feeding a paper sheet 12 to the plate-like member 18, the guide plate 30 is drawn up to the neighborhood of the plate-like member 18. On the other hand, for applying adhesive with the adhesive applying means 22 and also pressing paper sheets 12 with the pressing means 28, the guide plate 30 is retreated in the opposite direction to be separated from the adhesive applying means 22, etc.

The adhesive applying means 22 includes a spray 46 for spraying and applying adhesive on an end portion of each paper sheet 12 adjacent to the fold, and a spray 48 for spraying and coating adhesive on a paper sheet end portion adjacent to the other end. These sprays 46 and 48 respectively spray adhesive in liquid when a spray head is pushed by an air cylinder (not shown in the figure). They can be moved along the ends of the paper sheet 12 while spraying adhesive so as to be able to apply adhesive over the entire paper (entire width). The adhesive in liquid suitably does not only have strong adhesion with respect to the paper sheet 12 but also does not soak into or permeate the paper sheet 12. Particularly, such an adhesive is selected for use as not causing expansion or flexing of the paper sheet 12 when it is sprayed thereon. Although not limitative, it is preferable to use such an adhesive as is relatively quickly dried after it has been sprayed, i.e., dried to bond the next stacked paper sheet 12.

The cylinders mentioned in the above structure are not particularly limited; they may be air cylinders or oil hydraulic cylinders. The motor 64 also is not particularly limited so long as it can be rotated step-wise by a constant distance in each step; it may be a stepping motor, a servo motor, etc.

The folding means 16, stacking means 20, adhesive applying means 22, paper feeding means 24, fold producing means 26, pressing means 28, shifting means 29 and a guide 30 described above are driven while being controlled by a single controller (control means) to be able to perform a series of operations. The controller is not particularly limited; it may be a microcomputer board, a sequencer, etc.

In the operation of the bookbinding apparatus 10 having the above construction, a plurality of paper sheets 12 that are to be bound together, are stored in the paper feeding means 24 with their right sides bearing characters or the like as the upper side. The paper sheets 12 stored in the paper feeding means 24 are fed to the folding means 16 one at a time by the rotation of a roller 80.

Each paper sheet 12 fed to the folding means 16 is stopped and positioned by the positioning means 32 and detected by the sensor 14. When a paper sheet 12 is detected by the sensor 14, the cylinder 40 is driven to slide the insert plate 36 downward. By the downward sliding of the insert plate 36, the paper sheet 12 is folded to be forced between the two rollers 34. When the paper sheet 12 is forced between the two rollers 32, the sliding of the insert plate 36 by the cylinder 40 is stopped to hold the paper sheet 12 with the folded end thereof in contact with the plate 52. When the paper sheet 12 is thus held, the pressing member 50 is advanced by the cylinder 54 and pressed against the paper sheet 12 in contact with the plate 52 in the neighborhood of the folded end of the paper sheet 12. With the pressing of the pressing member 50 against the paper sheet 12 in the neighborhood of the folded end, a fold, along which the paper sheet 12 is folded in two, is produced clearer. In addition, the insert plate 36 may be retreated and removed from the folded paper sheet 12 right before the advancement of the pressing member 50, or it may be held in the folded paper sheet 12 when the paper sheet 12 is pressed by the pressing member 56. As a further alternative, the insert plate 36 may be removed from the folded paper sheet 12 while the paper sheet 12 is pressed by the pressing member 50.

After the pressing member 50 has been retreated, the paper sheet 12 is fed further downward by the rotating rollers 34 to fall onto the guide plate 30. At this time, the guide plate 30 has been advanced up to the neighborhood of the plate-like member 18 by the cylinder 78, so that the paper sheet 12 can be slid along the guide plate 30 to be fed onto the plate-like member 18. In addition, the paper sheet 12 is slowed down by the roller 44 with a brush as it is fed onto the plate-like member 18. The paper sheet 12 fed onto the plate-like member 18 strikes against and is stopped by the stopper 42.

Then, the guide plate 30 is retreated by the cylinder 78 from the neighborhood of the plate-like member 12. With the retreat of the guide plate 30, the paper sheet 12 falls onto and is set on the plate-like member 18. When the paper sheet 12 is set on the plate-like member 18, adhesive is applied to the paper sheet 12 by the sprays 46 and 48. At this time, the sprays 46 and 48 are moved in directions at right angles to the plane of the paper sheet. Every time one paper sheet 12 is set on the plate-like member 18, the motor 64 is driven for rotation by a constant amount to cause downward shift of the plate-like member 18 by a distance corresponding to the thickness of the folded paper sheet 12.

Following the above process, a plurality of paper sheets 12 are stacked and bonded together while they are successively set in the folded state on the plate-like member 18 and receive adhesive applied by the sprays 46 and 48. When the paper sheets 12 are stacked and bonded together, they are pressed by the pressing member 58 or 62. The pressing by the pressing member 58 or 62 may be performed whenever a paper sheet 12 is stacked or when all the paper sheets 12 have been stacked. As a further alternative, the pressing of paper sheets 12 only in the neighborhood of the fold with the pressing member 58 may be performed whenever a paper sheet 18 is stacked on the plate-like member 18, whereas it may perform to press over the entire area of the paper sheet 12 with the pressing member 62 when all the paper sheets 12 have been stacked.

Following the above process, as a plurality of paper sheets 12 are successively stacked, bonded and pressed, a book is produced, in which the paper sheets 12 are bonded together on their wrong sides 14 not bearing any characters or the like. The book thus obtained is desirably trimmed along its edges to obtain a neat shape.

The bookbinding apparatus 10 and bookbinding process as shown above according to the invention permit a series of automatic bookbinding operations of successively folding a plurality of paper sheets 12 in two with their wrong sides as the outer side and successively stacking the folded paper sheets on the plate-like member 18 while applying adhesive to each stacked paper sheet 12. It is thus possible to obtain a bookbinding operation which has been a very cumbersome operation in the prior art. In addition, the paper sheets 12 can be bonded together as they are stacked at a predetermined position on the plate-like member 18. It is thus possible to obtain accurate bonding of paper sheets 12 without deviation thereof and thus obtain a high quality book.

A further obtainable effect is that with the provision of the pressing means 28, which presses a plurality of paper sheets 12 stacked on the plate-like member 18 by the stacking means 20 and bonded together on the wrong sides, the paper sheets 12 can be more firmly bonded together. Therefore, reliable bookbinding is obtainable without possibility of deviation of the paper sheets 12 during the bookbinding operation. Besides, the pressing of the paper sheets 12 with the pressing means 28 makes the folds in the paper sheets 12 clearer to obtain neater bookbinding.

A still further obtainable effect is that with the provision of the paper feeding means 24 which feeds successively paper sheets 12 one at a time, paper sheets 12 can be automatically fed to the folding means 16, so that further automation of the bookbinding operation is obtainable. A yet further obtainable effect is that with the provision of the shifting means 29, which causes step-wise shift of the plate-like member 18 by a constant distance in each step in the downward direction, i.e., the direction opposite to the direction of stacking, every time a paper sheet 12 fed to the plate-like member 18 is stacked on the same, it is possible to hold constant the level of the top of the stacked paper sheets 12 on the plate-like member 18. Thus, each paper sheet 12 can be accurately stacked on and bonded to the top of the stacked paper sheets 12.

A still another obtainable effect is that with the provision of the slidable guide 30, when operating the adhesive applying means to apply adhesive to each paper sheet 12, the guide 30 is slid away so that it will not interfere with other parts such as the adhesive applying means 22. It is thus possible to automate the application of adhesive by the adhesive applying means 22.

A yet another obtainable effect is that with the provision of the fold producing means 32 the fold in the paper sheet 12 folded in two can be produced clearer. Thus, the fold can be produced accurately, and the folded paper sheet 12 can be accurately stacked on and bonded to the top of the stacked paper sheets 12 on the plate-like member 18.

While one example of the present invention has been described, it is possible to provide the apparatus for and methods for bookbinding according to the invention in other various ways as well.

Figure 2:
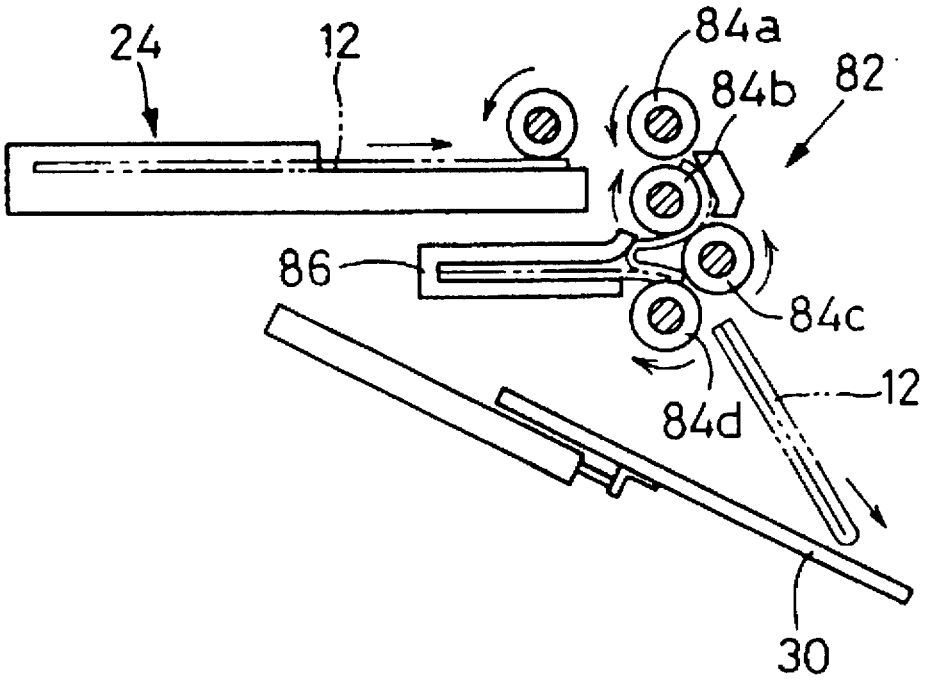
FIGS. 2 to 4 are fragmentary front views showing other examples of the bookbinding apparatus according to the present invention.

FIG. 2 shows one modification of the above bookbinding apparatus 10. This modification comprises folding means 82 for folding paper sheets 12 fed from the paper feeding means 24 in two. The folding means 82 includes a plurality of rollers 84*a* to 84*d* for feeding paper sheets 12 and a box-like member 86 for receiving and stopping paper sheet 12.

With the rotation of the rollers 84*a* to 84*b*, a paper sheet 12 is fed into the box-like member 86, and the paper sheet 12 is stopped when about one half from the leading end of the paper sheet 12 is fed into the box-like member 86. After the paper sheet 12 is stopped with about one half of the paper sheet 12 received in the box-like member 86, the remaining one half of it is further fed forcibly with continual rotation of the rollers 84*a* and 84*b*. With the forced feeding of the remaining one half of the paper sheet 12 while the preceding one half thereof held stationary in the box-like member 86, the paper sheet 12 is folded in two, and the paper sheet 12 is fed from its folded end through the space between the rollers 84*c* and 84*d* onto the guide plate 30. In this way, each paper sheet 12 is folded in two.

Figure 3:
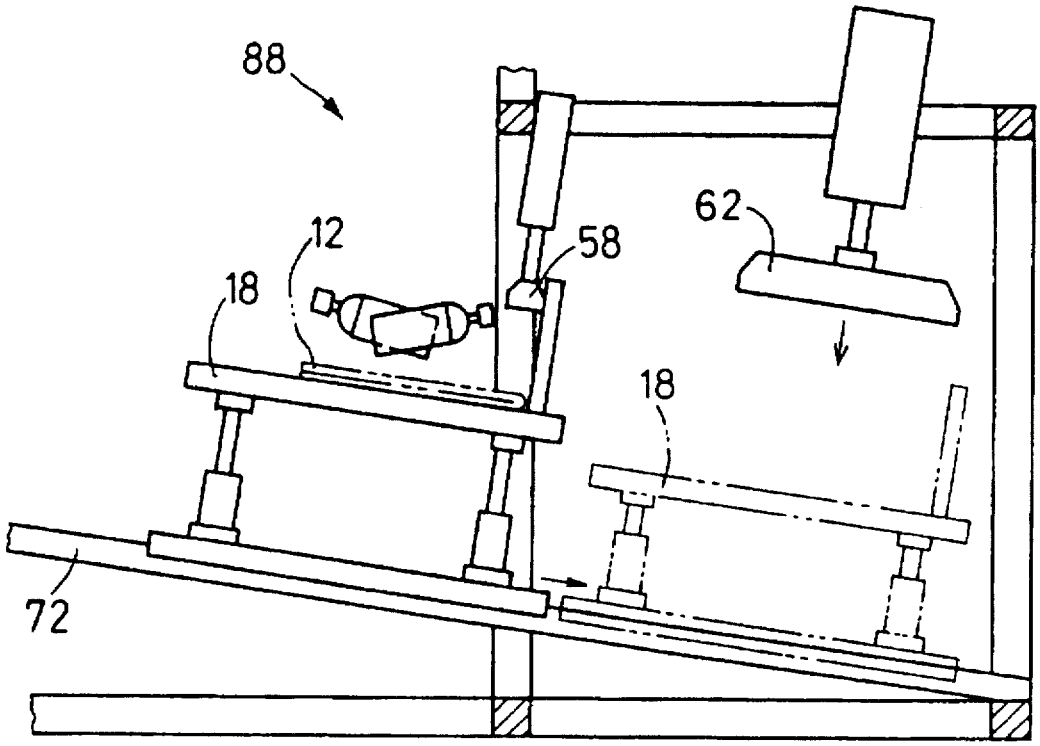

FIG. 3 shows a different modification of the bookbinding apparatus 10. This modification comprises pressing means 88. In this pressing means 88, the plate-like member 18 is adapted to be slid obliquely back-and forth along a frame 72, and the pressing members 58 and 62 effect pressing at different positions. Specifically, the pressing of paper sheets 12 in the neighborhood of the folds by the pressing member 58 is performed whenever a paper sheet 12 is fed onto the plate-like member 18, while the pressing of paper sheets 12 over the entire area thereof by the pressing member 62 is performed after all the paper sheets 12 dealt with have been stacked and the plate-like member 18 is obliquely slid. With this pressing means 88, which effects pressing of paper sheets at different positions with the pressing members 58 and 62, a position in the neighborhood of the folds pressed by the pressing member 58 can be pressed once again by the pressing member 62. Thus, the paper sheets 12 can be more firmly bonded together.

Figure 4:
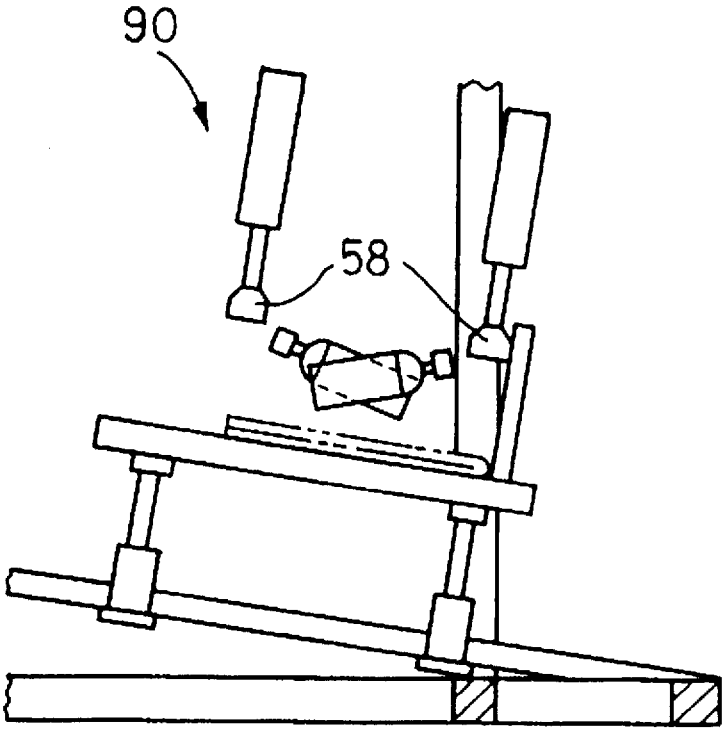

FIG. 4 shows a further modification of the bookbinding apparatus 10. This modification comprises pressing means 90, which includes two pressing members 58, one for pressing only the end part of paper sheets 12 in the neighborhood of the folds and the other for pressing paper sheets 12 only in the neighborhood of the other end. Such pressing means permit somewhat firmer bonding of the paper sheets 12. As a still further modification, while paper sheets 12 are held pressed on the end in the neighborhood of the folds by one pressing member 58, a roller-like pressing member (not shown in the figure) may be caused to roll over the paper sheet stack while pressing thereof from the neighborhood of the fold end toward the other end. As shown, the pressing means can be constructed variously.

Figure 5:
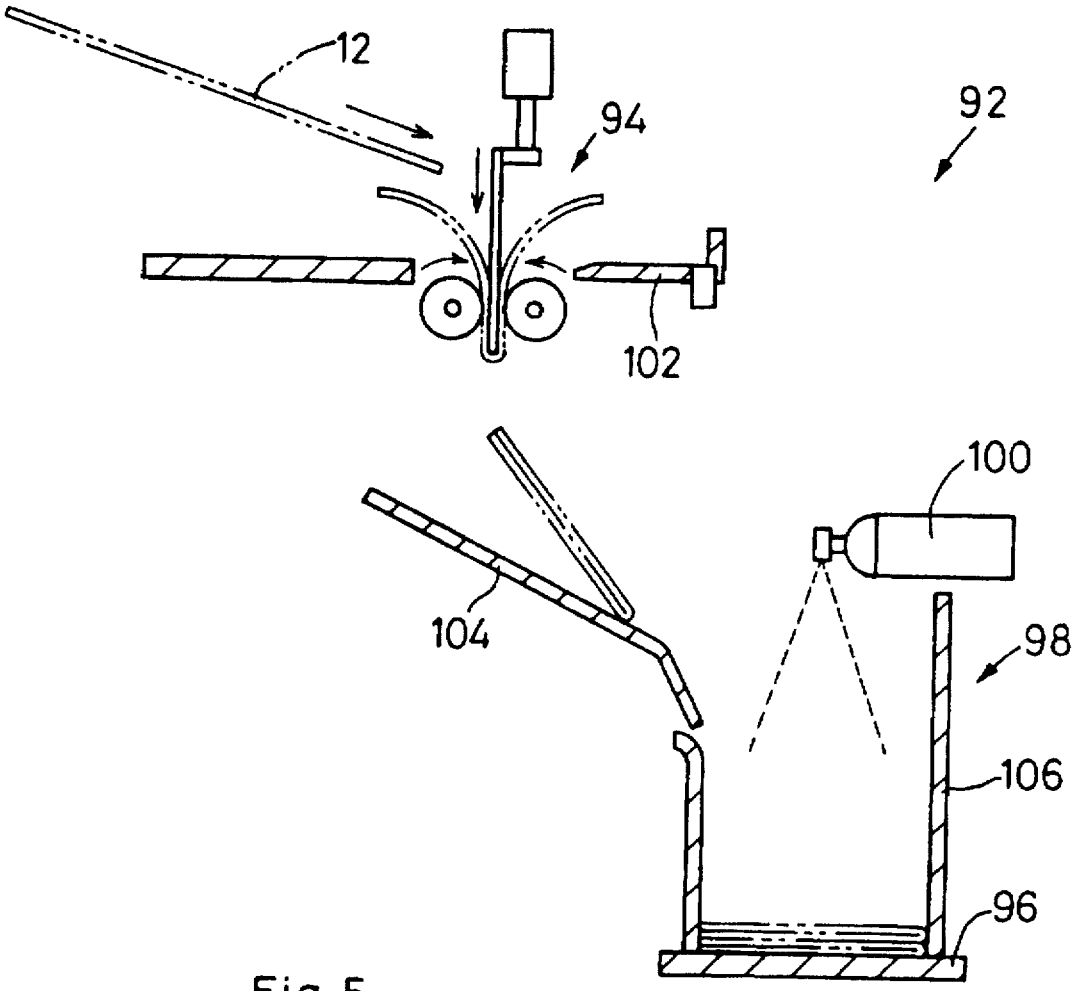
FIGS. 5 to 9 are fragmentary front views showing further examples of the bookbinding apparatus according to the present invention.

FIG. 5 shows a further bookbinding apparatus 92 according to the invention. This bookbinding apparatus 92 comprises folding means 94 for folding paper sheets 12 in two with their wrong sides as the outer side, stacking means 98 for successively feeding the folded paper sheets 12 to a predetermined position on a plate-like member 96 for stacking, and a spray (or adhesive applying means) 100 for applying adhesive to the wrong sides of the paper sheets 12. This bookbinding apparatus 92 comprises minimum constituent elements necessary for the present invention.

In this bookbinding apparatus 92, a paper sheet 12 is manually fed onto a slide plate 102. The paper sheet 12 fed onto the slide plate 102 is folded in two by the folding means 94 to be fed onto a guide 102. The paper sheet 12 fed onto the guide 102 slides along the guide 102 to be entered into a case 106. The inside dimensions of the case 106 and the dimensions of the folded paper sheets 12 are set to be the same to permit the paper sheet 12 to be stored in the case 106 without room. The paper sheet 12 in the case 106 is applied with adhesive on the wrong side thereof by the spray 100 operated.

Thus, while applied with adhesive, the paper sheets 12 are stacked successively to adhere the paper sheets 12 to bind a book. In addition, in the bookbinding operation according to the bookbinding apparatus 92, after the adhesion of all paper sheets 12 are finished, it is preferable to manually or in other way press a plurality of the paper sheets 12. The book thus obtained is desirably trimmed along its edges to obtain a neat shape.

Figure 6:
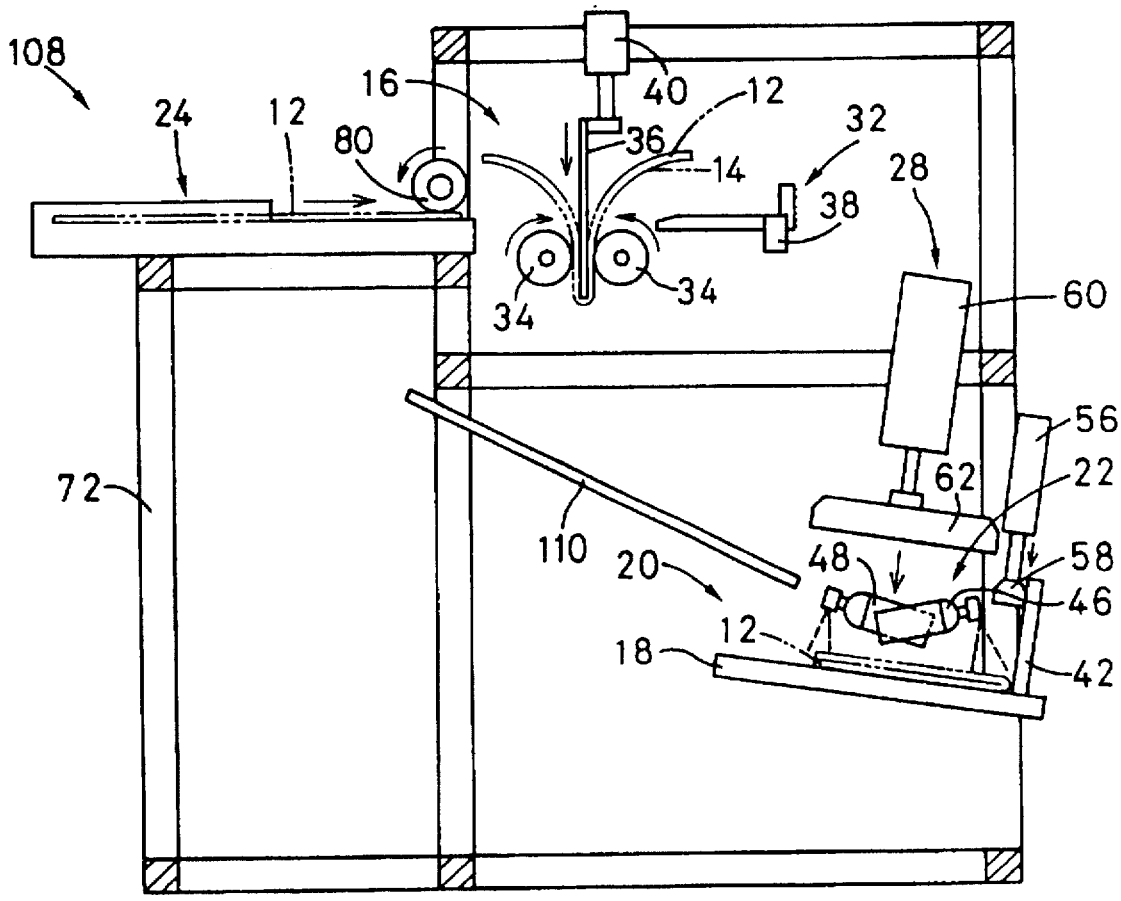

FIG. 6 shows a still further bookbinding apparatus 108 according to the present invention. This bookbinding apparatus 108 comprises paper feeding means 24 for successively feeding a plurality of paper sheets 12 with their right sides thereof bearing characters or the like, folding means 16 for folding the paper sheets 12 in two with their wrong sides 14 not bearing any characters or the like as the outer side, stacking means 20 for feeding the folded paper sheets 12 to a predetermined position on the plate-like member 18 for stacking, adhesive applying means 22 for applying adhesive (adhesive material) to the wrong sides 14 of the paper sheets fed to the predetermined position, and pressing means 28 for pressing the plurality of paper sheets stacked by the stacking means 20 and received adhesive applied by the adhesive applying means 22. In addition, reference numeral 110 designates a guide plate for guiding the folded paper sheets 12 onto the plate-like member 18 of the stacking means 20. The guide plate 110 is secured to a frame.

The bookbinding apparatus 108 may further comprise fold producing means 26 for producing folds in the paper sheets 12 folded in two by the folding means 16.

Figure 7:
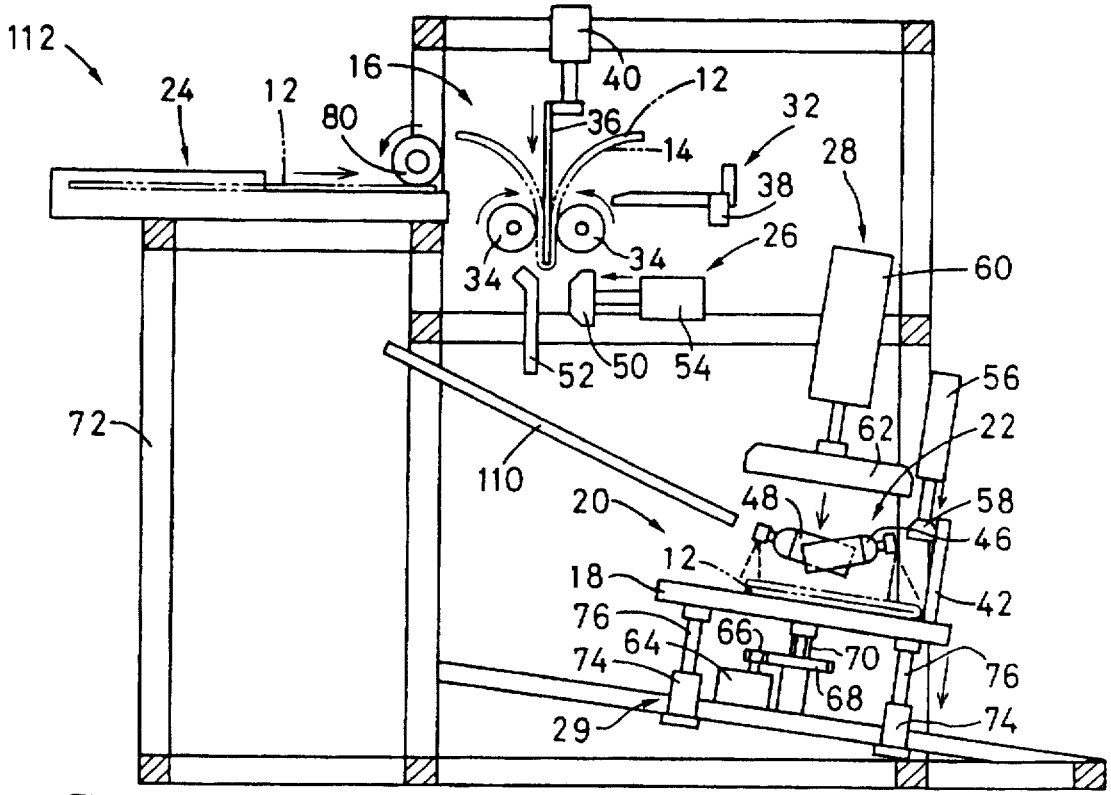

FIG. 7 shows a further bookbinding apparatus 112 according to the present invention. This apparatus comprises paper feeding means 24 for successively feeding a plurality of paper sheets 12 with their right sides bearing characters, drawings, etc., folding means 16 for folding the paper sheets in two with their wrong sides not bearing any characters or the like as the outer side, fold producing means 26 for producing folds in the paper sheets folded in two by the folding means 16, stacking means 20 for stacking the folded paper sheets 12 with folds by successively feeding them to a predetermined position on the plate-like member 18, shifting means for causing step-wise shift of the plate-like member 18 by a constant distance in each step in the direction opposite to the direction of stacking paper sheets 12 by the stacking means 20, adhesive applying means 22 for applying adhesive (adhesive material) on the wrong sides 14 of the paper sheets 12 fed to the predetermined position, and pressing means 28 for pressing the plurality of paper sheets 12 stacked by the stacking means 20 and received adhesive applied by the adhesive applying means 22. Reference numeral 110 is a guide for guiding the folded paper sheets 12 onto the plate-like member 18 of the stacking means 20. The guide plate 110 is secured to a frame.

Figure 8:
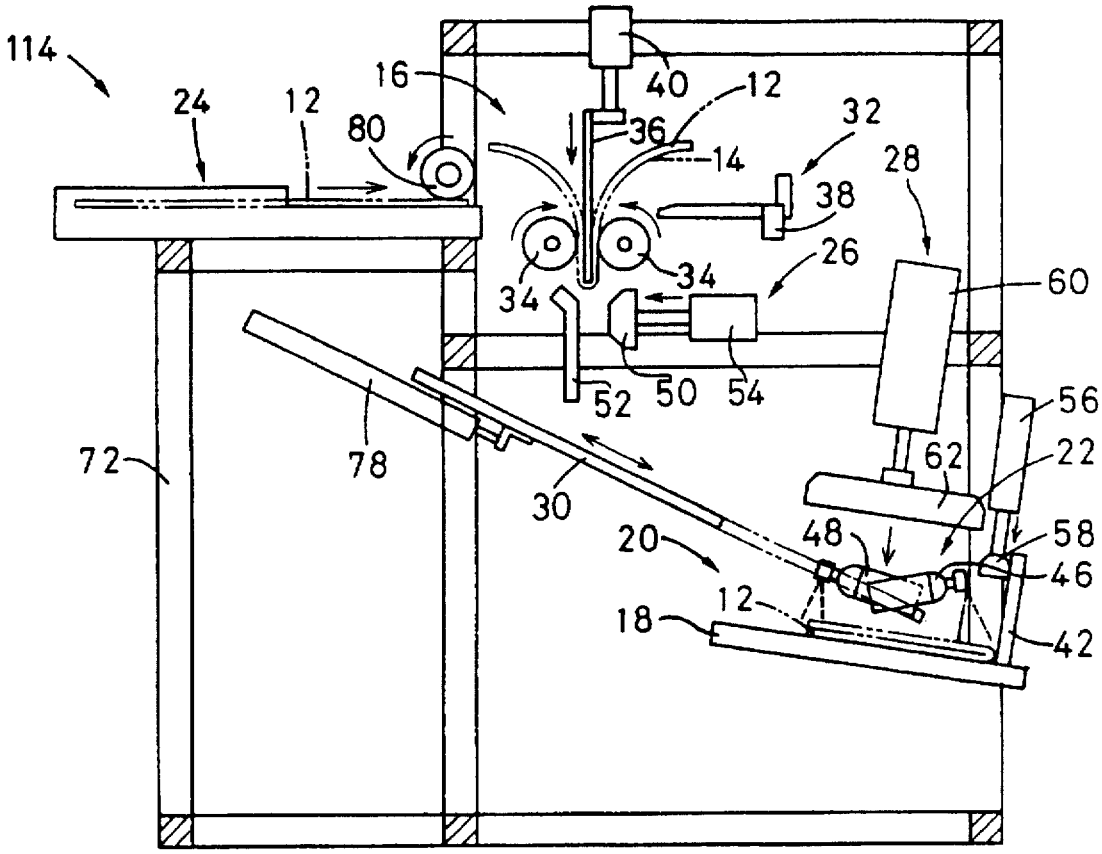

FIG. 8 shows a still further bookbinding apparatus 114 according to the invention. This bookbinding apparatus 114 comprises paper feeding means 24 for successively feeding a plurality of paper sheets one at a time with their right sides bearing characters, drawings, etc., folding means 16 for folding the paper sheets in two with their wrong sides not bearing any characters or the like as the outer side, fold producing means 26 for producing folds in the paper sheets 12 folded in two by the folding means 16, a guide 30 for feeding the paper sheets 12 by sliding them in order that the paper sheets are stacked on the plate-like member 19, stacking means 20 for stacking the folded paper sheets 12 with folds to a predetermined position on the plate-like member 18 by successively feeding them, adhesive applying means 22 for applying adhesive to the wrong sides 14 of the paper sheets 14 fed to the predetermined position, and pressing means 28 for pressing the plurality of paper sheets 12 stacked by the stacking means 20 and received adhesive applied by the adhesive applying means.

Figure 9:
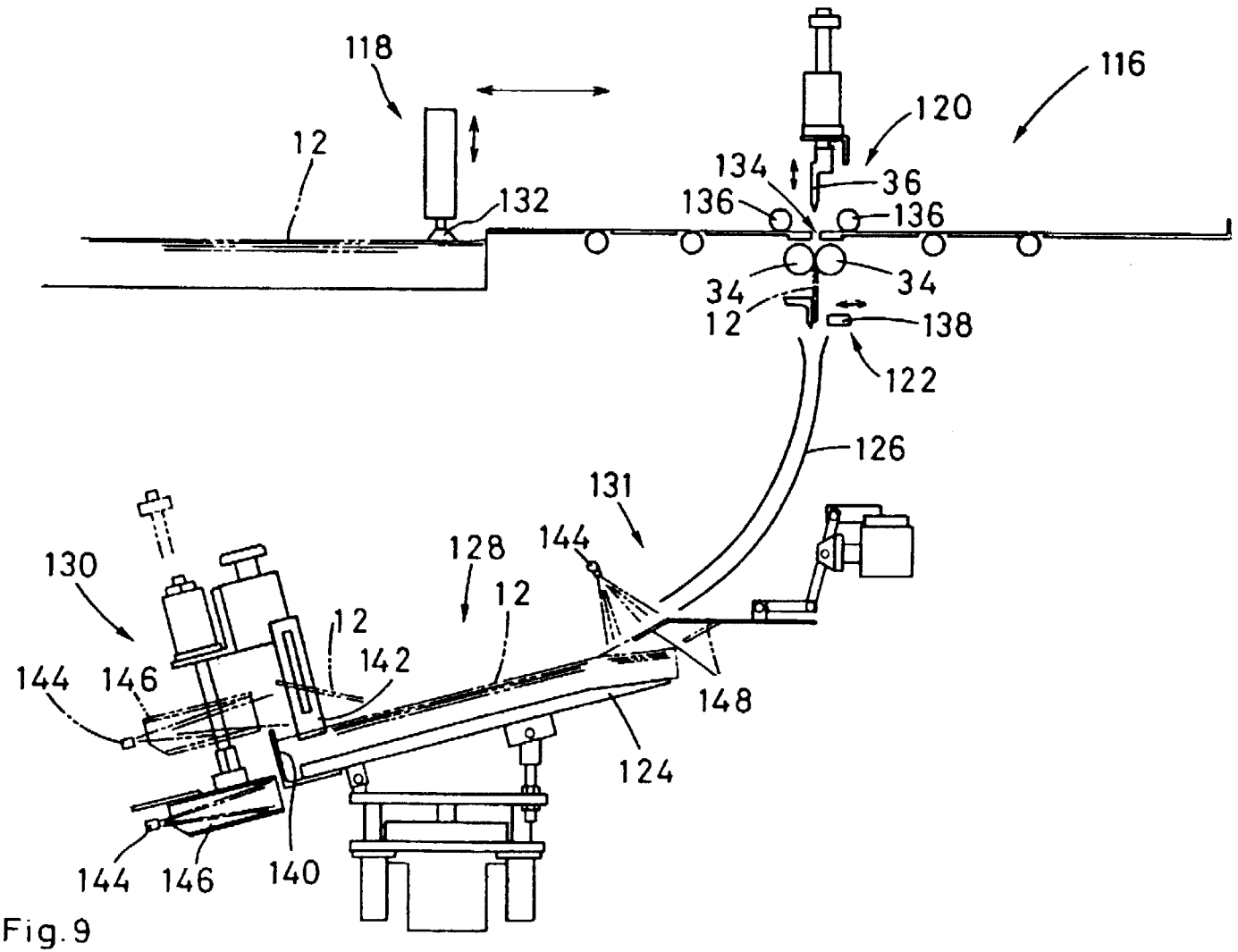
Figure 10:
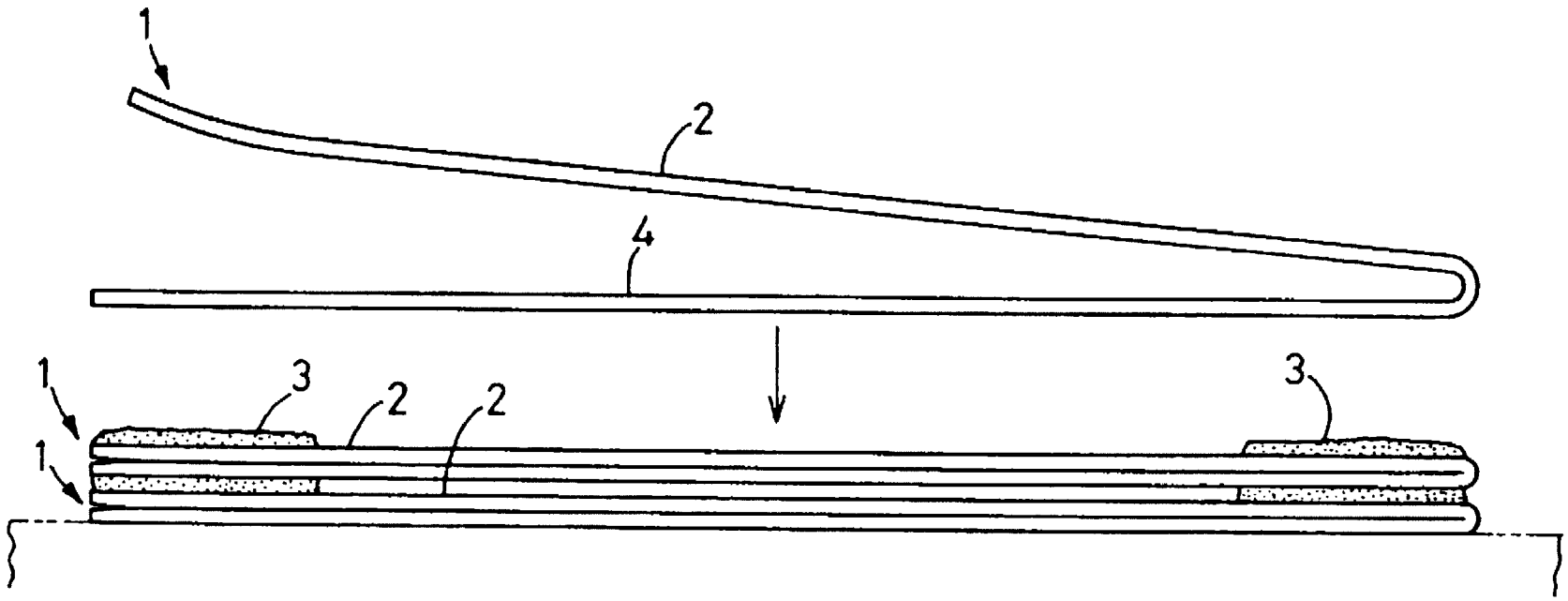
Fig.10 PRIOR ART
FIG. 10 is a front view for explaining a conventional bookbinding process.

FIG. 9 shows a still further bookbinding apparatus 116 according to the invention. This bookbinding apparatus 116 comprises paper feeding means 118 for successively feeding a plurality of paper sheets one at a time, folding means 120 for folding the paper sheets in two with their wrong sides not bearing any characters or the like as the outer side, fold producing means 122 for producing folds in the paper sheets 12 folded in two by the folding means 120, a guide plate 126 in circular arc for feeding the paper sheets 12 by sliding them in order that the paper sheets are stacked on the plate-like member 122, stacking means 128 for stacking the folded paper sheets 12 with folds to a predetermined position on the plate-like member 124 by successively feeding them, adhesive applying means 130 and 131 for applying adhesive to the wrong sides of the paper sheets fed to the predetermined position.

Paper feeding means 118 according to the present invention comprises that paper feeding can be performed by that the paper sheets 12 are absorbed and clung with an acetablum 132, by feeding the paper sheets 12 one at a time to the predetermined position and by cancelling the absorption. Folding means 120 comprises insert plate 36 driven by a cylinder or the like, slit member 132 through which the insert plate 36 and folded paper sheets 12 pass, a pair of rollers 34 and pressing roller 136. Therefore, after the paper sheet 12 is fed to the predetermined position with the pressing roller 136, it is stopped. Following it, insert plate 36 comes down to the paper sheet 12. While folding the paper sheet 12, the insert plate 36 passes through the slit 132 to the space between a pair of rolls 34 with the paper sheet 12 folded at least at the top part of the insert plate 36. At that time a pair of rollers 34 are rotated, and the paper sheet 12 inserted between the rollers 34 is fed successively. On the other hand, the insert plate 36 is retreated. The paper sheet 12 fed by a pair of rollers 34 is stopped at the position of fold producing means 122. The folded part of the paper sheet 12 is pressed by a pressing means 138 having elasticity, and the pressing means 138 is moved along the folded part of the paper sheet 12. Thus a fold is produced on the paper sheet 12. Following this, a pair of rollers 34 are rotated and the paper sheet 12 with a fold is dropped.

The paper sheet 12 is sled down along the guide plate 126 in circular arc and fed to the predetermined position on the plate-like member 124 of the stacking means 128. The end of the paper sheet 12 strikes the stopper plate 120 and the paper sheet 12 is placed neatly, thus paper sheets 12 are stacked successively. The adhesive applying means 130 near the stopper plate 140 between adhesive applying means 130 and 131 for applying adhesive to the paper sheets 12 stacked on the plate-like member 124 comprises a lifting hook 142 for lifting the end of the paper sheets 12, a nozzle 144 for spraying adhesive and a guide barrel 146 for preventing the sprayed adhesive from diffusing. On the other hand, the adhesive applying means 131 near the guide plate 126 comprises a movable plate 148 which plays a part of a guide for the paper sheets 12 sliding down the guide plate 126 and is for stabilizing the spraying of adhesive agent, and a nozzle 144 for spraying adhesive agent. Accordingly, after the paper sheet 12 fed onto the plate-like member 124 is positioned, the end of the paper sheets 12 is lifted by the lifting hook 142 and adhesive agent sprayed from the nozzle 144 is applied onto the end of the paper sheet 12. After that the lifting hook 142 is released, and the paper sheet 12 applied with adhesive agent is adhered with another lower paper sheet 12. On the other hand, the end of the paper sheet 12 is on the movable plate 148, and adhesive agent is sprayed and applied onto the paper end from the nozzle 144. Then the movable plate 148 is drawn away to drop the end of the paper sheet 12. At that time because the end of the lower paper sheet 12 is applied with adhesive agent, the upper paper sheet 12 and the lower paper sheet 12 are bonded. Though the end of the upper paper sheet 12 is applied with adhesive agent, the upper paper sheet 12 is not bonded with another folded paper 12 which is sliding down successively, because the movable plate 148 is proceeded. Further, because upper part of the end of the paper sheet 12 on the side of the stopper plate 140 is not applied with adhesive agent, it is not adhered.

From the above operation paper sheets 12 are back-bonded successively, and concerning the last paper sheet 12, the end part thereof on the movable plate 148 is not applied with adhesive agent.

With the various bookbinding apparatuses described above, substantially the same functions and effects are obtainable, and it is further possible to construct various other bookbinding apparatuses.

While various examples of the present invention have been described, the present invention is not limited to the above examples. For example, it is possible to provide cutting means for cutting edges of a book produced on the plate-like member 18. Also, it is possible to provide an air fan (drier) for drying the adhesive by supplying air to the paper sheets 12 bonded on the plate-like member 18.

As for the bonding together of a plurality of paper sheets 12, the application of a liquid adhesive is not limitative; for instance, it is possible to use a powdery adhesive or an adhesive tape as well. For example, a powdery adhesive is sprayed like the liquid adhesive in the above examples to bond together the folded paper sheets 12. In this case, the pressing means is provided with a heater, for instance an iron heater, to heat the stacked paper sheets 12 while pressing the same to cause fusing of the powdery adhesive and thus effect the bonding. Likewise, the paper sheets 12 may be heated for bonding with a heater after sandwiching an adhesive sheet between two paper sheets. By using such a dry adhesive, it is possible to bond paper sheets after positioning the end of stacked paper sheets. Accordingly, this arrangement is particularly useful for the example shown in FIG. 5, for instance. In addition, the pressing means with a heater need only bond together stacked paper sheets with a thermally fusing powdery adhesive or an adhesive sheet, and may not have a sufficient function as pressing means.

Furthermore, the fold producing means may have such a structure as a roller or a slide member being caused to roll or slide along the fold while it is pressed. It is further possible to dispense with the fold producing means by providing the pressing means with a function and an effect like those of the fold producing means.

Moreover, it is possible to appropriately combine the above embodiments and various constituent elements shown in the embodiments or omit some constituent elements which may be unnecessary. It is further possible to make other various changes and modifications on the basis of the knowledge of those who are skilled in the art without departing from the spirit and scope of the present invention.

What is claimed is:

1. An bookbinding apparatus for back-bonding by folding in half a plurality of paper sheets, each paper sheet of said plurality of paper sheets having a first side, which bears characters thereon, and a second opposed side, which does not bear any characters thereon, said second opposed side of each paper sheet of said plurality of sheets being an outer side such that said second opposed sides of said plurality of paper sheets, after being folded, are bonded together, said apparatus comprising:

folding means for folding each paper sheet of said plurality of paper sheets in half with said second opposed sides of each paper sheet of said plurality of paper sheets being said outer side;

stacking means for stacking each paper sheet of said plurality of paper sheets, after each sheet of said plurality of paper sheets has been folded, while successively feeding each sheet of said plurality of paper sheets to a predetermined position on a plate-shaped member; and adhesive applying means for applying adhesive material to said second opposed sides of each sheet of said plurality of paper sheets fed to said predetermined position, wherein each paper sheet of said plurality of paper sheets is successively bonded together on said second opposed side as each paper sheet of said plurality of paper sheets are fed to said plate-shaped member.

2. The bookbinding apparatus according to claim 1, further comprising pressing means for pressing together each paper sheet of said plurality of paper sheets, after each sheet of said plurality of paper sheets has been folded, and after each paper sheet of said plurality of paper sheets have been stacked by said stacking means.

3. The bookbinding apparatus according to any one of claims 1 and 2, further comprising paper feeding means for successively feeding each paper sheet of said plurality of paper sheets one at a time to said folding means.

4. The bookbinding apparatus according to any one of claims 1 and 2, further comprising shifting means for causing a step-wise shift of said plate-shaped member by a constant distance in each step in a direction opposite to a direction of stacking of each paper sheet of said plurality of paper sheets by said stacking means.

5. The bookbinding apparatus according to any one of claims 1 and 2, further comprising a guide plate means for feeding said plurality of paper sheets by sliding each paper sheet of said plurality of paper sheets so that each paper sheet of said plurality of paper sheets can be stacked on said plate-shaped member, and said guide plate means sliding of each sheet of said plurality of paper sheets does not interfere with other parts of said bookbinding apparatus.

6. The bookbinding apparatus according to any one of claims 1 and 2, further comprising fold producing means for producing folds in each paper sheet of said plurality of paper sheets folded in half by said folding means.

7. An bookbinding apparatus for back-bonding by folding in half a plurality of paper sheets, each paper sheet of said plurality of paper sheets having a first side, which bears characters thereon, and a second opposed side, which does not bear any characters thereon, said second opposed side of each paper sheet of said plurality of sheets being an outer side such that said plurality of paper sheets, after being folded, are bonded together on said second opposed sides thereof, said apparatus comprising:

paper feeding means for successively feeding each paper sheet of said plurality of paper sheets one at a time;

folding means for folding each paper sheet of said plurality of paper sheets in half with said second opposed sides of said plurality of paper sheets being said outer side;

stacking means for stacking each paper sheet of said plurality of paper sheets, after each sheet of said plurality of paper sheets has been folded, while successively feeding each sheet of said plurality of paper sheets to a predetermined position on a plate-shaped member;

adhesive applying means for applying adhesive material to said second opposed sides of each sheet of said plurality of paper sheets fed to said predetermined position; and pressing means for pressing together a plurality of paper sheets which are stacked by said stacking means and adhered with adhesive material by said adhesive applying means, wherein each paper sheet of said plurality of paper sheets is successively bonded together on said second opposed side as each paper sheet of said plurality of paper sheets are fed to said plate-shaped member.

8. An bookbinding apparatus for back-bonding by folding in half a plurality of paper sheets, each paper sheet of said plurality of paper sheets having a first side, which bears characters thereon, and a second opposed side, which does not bear any characters thereon, said second opposed side of each paper sheet of said plurality of sheets being an outer side such that said plurality of paper sheets, after being folded, are bonded together on said second opposed sides thereof, said apparatus comprising:

paper feeding means for successively feeding each paper sheet of said plurality of paper sheets one at a time;

folding means for folding each paper sheet of said plurality of paper sheets fed thereto in half with said second opposed sides of said plurality of paper sheets being said outer side;

fold producing means for producing folds in each paper sheet of said plurality of paper sheets, after each paper sheet of said plurality of paper sheets has been folded in half by said folding means;

stacking means for stacking each paper sheet of said plurality of paper sheets, after each sheet of said plurality of paper sheets has been folded, while successively feeding each sheet of said plurality of paper sheets to a predetermined position on a plate-shaped member;

adhesive applying means for applying adhesive material to said second opposed sides of each sheet of said plurality of paper sheets fed to said predetermined position; and pressing means for pressing a plurality of paper sheets which are stacked by said stacking means and adhered with adhesive material by said adhesive applying means, wherein each paper sheet of said plurality of paper sheets is successively bonded together on said second opposed side as each paper sheet of said plurality of paper sheets are fed to said plate-shaped member.

9. An bookbinding apparatus for back-bonding by folding in half a plurality of paper sheets, each paper sheet of said plurality of paper sheets having a first side, which bears characters thereon, and a second opposed side, which does not bear any characters thereon, said second opposed side of each paper sheet of said plurality of sheets being an outer side such that said plurality of paper sheets, after being folded, are bonded together on said second opposed sides thereof, said apparatus comprising:

paper feeding means for successively feeding each paper sheet of said plurality of paper sheets;

folding means for folding each paper sheet of said plurality of paper sheets fed thereto in half with said second opposed sides of said plurality of paper sheets being said outer side;

fold producing means for producing folds in each paper sheet of said plurality of paper sheets, after each paper sheet of said plurality of paper sheets has been folded in half by said folding means;

stacking means for stacking each paper sheet of said plurality of paper sheets, after each sheet of said plurality of paper sheets has been folded, while successively feeding each sheet of said plurality of paper sheets to a predetermined position on a plate-shaped member;

shifting means for causing a step-wise shift of said plate-shaped member by a constant distance in each step in a direction opposite to a direction of stacking of each paper sheet of said plurality of paper sheets by said stacking means;

adhesive applying means for applying adhesive material to said second opposed sides of each sheet of said plurality of paper sheets fed to said predetermined position; and pressing means for pressing a plurality of paper sheets which are stacked by said stacking means and adhered with adhesive material by said adhesive applying means, wherein each paper sheet of said plurality of paper sheets is successively bonded together on said second opposed side as each paper sheet of said plurality of paper sheets are fed to said plate-shaped member.

10. An bookbinding apparatus for back-bonding by folding in half a plurality of paper sheets, each paper sheet of said plurality of paper sheets having a first side, which bears characters thereon, and a second opposed side, which does not bear any characters thereon, said second opposed side of each paper sheet of said plurality of sheets being an outer side such that said plurality of paper sheets, after being folded, are bonded together on said second opposed sides thereof, said apparatus comprising:

paper feeding means for successively feeding each paper sheet of said plurality of paper sheets one at a time;

folding means for folding each paper sheet of said plurality of paper sheets in half with said second opposed sides of said plurality of paper sheets being said outer side;

fold producing means for producing folds in each paper sheet of said plurality of paper sheets, after each paper sheet of said plurality of paper sheets has been folded in half by said folding means;

a guide plate means for feeding said plurality of paper sheets by sliding each paper sheet of said plurality of paper sheets so that each paper sheet of said plurality of paper sheets can be stacked on said plate-shaped member;

stacking means for stacking each paper sheet of said plurality of paper sheets, after each sheet of said plurality of paper sheets has been folded, while successively feeding each sheet of said plurality of paper sheets to a predetermined position on a plate-shaped member;

adhesive applying means for applying adhesive material to said second opposed sides of each sheet of said plurality of paper sheets fed to said predetermined position; and pressing means for pressing a plurality of paper sheets which are stacked by said stacking means and adhered with adhesive material by said adhesive applying means, wherein each paper sheet of said plurality of paper sheets is successively bonded together on said second opposed side as each paper sheet of said plurality of paper sheets are fed to said plate-shaped member.

11. An bookbinding apparatus for back-bonding by folding in half a plurality of paper sheets, each paper sheet of said plurality of paper sheets having a first side, which bears characters thereon, and a second opposed side, which does not bear any characters thereon, said second opposed side of each paper sheet of said plurality of sheets being an outer side such that said plurality of paper sheets, after being folded, are bonded together on said second opposed sides thereof, said apparatus comprising:

paper feeding means for successively feeding each paper sheet of said plurality of paper sheets one at a time;

folding means for folding each paper sheet of said plurality of paper sheets fed thereto in half with said second opposed sides of said plurality of paper sheets being said outer side;

fold producing means for producing folds in each paper sheet of said plurality of paper sheets, after each paper sheet of said plurality of paper sheets has been folded in half by said folding means;

a guide plate means for feeding said plurality of paper sheets by sliding each paper sheet of said plurality of paper sheets so that each paper sheet of said plurality of paper sheets can be stacked on said plate-shaped member;

stacking means for stacking each paper sheet of said plurality of paper sheets, after each sheet of said plurality of paper sheets has been folded, while successively feeding each sheet of said plurality of paper sheets to a predetermined position on a plate-shaped member; and shifting means for causing a step-wise shift of said plate-shaped member by a constant distance in each step in a direction opposite to a direction of stacking of each paper sheet of said plurality of paper sheets by said stacking means;

adhesive applying means for applying adhesive material to said second opposed sides of each sheet of said plurality of paper sheets fed to said predetermined position; and pressing means for pressing a plurality of paper sheets which are stacked by said stacking means and adhered with adhesive material by said adhesive applying means, wherein each paper sheet of said plurality of paper sheets is successively bonded together on said second opposed side as each paper sheet of said plurality of paper sheets are fed to said plate-shaped member.

12. A process of back-bonding bookbinding by folding in half each paper sheet of a plurality of paper sheets having a first side which bears characters thereon and a second opposed side which does not bear any characters thereon, said second opposed side being an outer side and bonding together said second opposed sides of said plurality of paper sheets, comprising the steps of:

folding each paper sheet of said plurality of paper sheets in half with said second opposed sides as said outer side with folding means;

applying adhesive to said second opposed sides of said paper sheets with adhesive applying means, after said plurality of paper sheets have been folded;

pressing together said wrong sides of said plurality of paper sheets, after said plurality of paper sheets have been folded and had adhesive applied;

feeding said plurality of paper sheets to a predetermined position on a plate-shaped member; and stacking said plurality of paper sheets with stacking means.

13. The process of bookbinding according to claim 12, further comprising the step of shifting said plate-shaped member step-wise by a constant distance in each step in a direction opposite to a direction of stacking said plurality of paper sheets by said stacking means.

14. The process of bookbinding according to claim 13, wherein during said shifting step a guide plate is shifted so as not to interfere with other parts of a bookbinding apparatus in said bookbinding process, and each of said paper sheets of said plurality of paper sheets are fed by being slid on said guide plate in order to be stacked on said plate-like member.

15. The bookbinding apparatus according to claim 3, further comprising shifting means for causing a step-wise shift of said plate-shaped member by a constant distance in each step in a direction opposite to a direction of stacking said plurality of paper sheets by said stacking means.

16. The bookbinding apparatus according to claim 3, further comprising a guide plate means for feeding said plurality of paper sheets by sliding each paper sheet of said plurality of paper sheets so that said plurality of paper sheets can be stacked on said plate-shaped member, and said sliding of said plurality of paper sheets by said guide plate means does not interfere with other parts of said bookbinding apparatus.

17. The bookbinding apparatus according to claim 4, further comprising a guide plate means for feeding said plurality of paper sheets by sliding each paper sheet of said plurality of paper sheets so that said plurality of paper sheets can be stacked on said plate-shaped member, and said sliding of said plurality of paper sheets by said guide plate means does not interfere with other parts of said bookbinding apparatus.

18. The bookbinding apparatus according to claim 3, further comprising folding means for folding each paper sheet of said plurality of paper sheets in half.

19. The bookbinding apparatus according to claim 4, further comprising folding means for folding each paper sheet of said plurality of paper sheets in half.

20. The bookbinding apparatus according to claim 5, further comprising folding means for folding each paper sheet of said plurality of paper sheets in half.

* * * * *